United States Patent [19]

Blundy

[11] Patent Number: 5,064,051

[45] Date of Patent: Nov. 12, 1991

[54] METHODS OF AND APPARATUS FOR TRANSFERRING PLATE-LIKE ARTICLES FROM ONE LOCATION TO ANOTHER

[75] Inventor: Robert F. Blundy, Columbia, S.C.

[73] Assignee: American Telephone and Telegraph Company, New York, N.Y.

[21] Appl. No.: 557,258

[22] Filed: Jul. 24, 1990

[51] Int. Cl.[5] ..... B22D 5/02

[52] U.S. Cl. ..... 198/466.1; 198/413; 198/468.6; 164/270.1; 414/680; 414/223; 414/786

[58] Field of Search ..... 198/466.1, 409, 412, 198/413, 468.6; 164/270.1; 414/222, 223, 680, 745.7, 729, 786

[56] References Cited

U.S. PATENT DOCUMENTS

| | | | |
|---|---|---|---|
| 2,579,094 | 12/1951 | Rooksby | 271/84 |
| 3,314,554 | 4/1967 | Cuniberti . | |
| 3,715,048 | 2/1973 | Raab . | |
| 3,799,322 | 3/1974 | Van Linder et al. | 198/466.1 X |
| 3,850,319 | 11/1974 | DiFrank et al. . | |
| 3,935,091 | 1/1976 | Rautimo et al. | 204/281 |
| 3,938,672 | 2/1976 | Leiponen et al. | 414/729 |
| 3,996,127 | 12/1976 | Rautimo et al. | 204/281 |
| 4,455,724 | 6/1984 | Sperling et al. | 198/466.1 X |
| 4,807,689 | 2/1989 | Beneitone | 198/466.1 X |

*Primary Examiner*—Frank E. Werner
*Assistant Examiner*—James T. Eller, Jr.
*Attorney, Agent, or Firm*—E. W. Somers

[57] ABSTRACT

An apparatus (20) is provided for transferring articles (40—40) from a pickup position to a pickoff position and then to a dropoff position. The apparatus includes a pair of pickup arms (60—60) which are spaced apart to engage lugs (42—42) oppositely extending from an article to be transferred. As the transfer arms are caused to be moved rotatably, the article is transferred to the pickoff position whereat the lugs are adjacent to stepped end portions (88—88) of a pair of pickoff arms (80—80). Further movement of the transfer arms causes the article to engage surfaces (92—92) of the stepped free ends of the pickoff arms and to be supported by engagement of the lugs with surfaces (94—94) of the stepped end portions of the pickoff arms. Afterwards, the pickoff arms are turned to allow the article to descend until, at a predetermined position, the lugs of the article become engaged with a conveyor (100) and become disengaged from the pickoff arms. Successive ones of the articles are supported by engagement of the lugs with the conveyor such that main body portions of the articles are submerged in a treating bath beneath the conveyor.

13 Claims, 4 Drawing Sheets

METHODS OF AND APPARATUS FOR TRANSFERRING PLATE-LIKE ARTICLES FROM ONE LOCATION TO ANOTHER

TECHNICAL FIELD

This invention relates to methods of and apparatus for transferring articles from one location to another. More particularly, this invention relates to methods of and apparatus for transferring anode plates from a casting apparatus to a cooling tank.

BACKGROUND OF THE INVENTION

In the production of many metals in rod form, for example, it is commonplace to provide batch supplies of anode plates from a melting furnace by casting. The anode plates after casting from the furnace and after being cooled are used in an electrochemical deposition process in which the anode plates are suspended in a chemical solution and metallic ions are caused to dissolve and be redeposited onto a cathode plate.

More specifically, copper scrap is melted in a large furnace after which the furnace discharges the molten metal into anode plate molds supported on a rotating carriage. At a pickup position opposite to a pour point, a device pushes upwardly and a transfer device engages lugs extending in opposite directions from side edges of the anode plate in the pickup position. The transfer device moves each newly cast anode plate from the carriage to a conveyor for immersion in a cooling bath.

Subsequently, in plating tanks, the anode plates and a plurality of cathode plates are suspended in baths of sulphuric acid which is then subjected to a relatively high current. This causes copper from the anode plates to deposit onto cathode plates. Impurities in the copper in the anode plates are removed in the plating tanks so that the copper which is plated onto the cathode plates has a very high degree of purity.

Various arrangements have been implemented for transferring anode plates from a casting apparatus to a cooling bath. For example, as is shown in U.S. Pat. No. 3,715,048, it is known to use a carriage which moves along rails. The carriage is provided with grippers which grip lugs of anode plates. Such an arrangement which is linearly moving with gripping members is expensive and consumes an undesirably large amount of space.

Another typical transfer mechanism is disclosed in U.S. Pat. No. 3,938,672. In it, a transfer arm operates back and forth between a pickup position and a dropoff position. At the pickup point, grippers on ends of rotatably movable arms are caused to be moved toward each other to engage lugs extending in opposite directions from the anode plate to be transferred. After each anode plate has been transferred to a cooling bath, the grippers are caused to be moved outwardly from the anode plate to release the plate and allow it to be supported by rails or the like adjacent to a cooling tank.

Transfer mechanisms such as the ones described hereinabove which currently are in use are somewhat complex and require what is perceived to be an undue amount of maintenance. For example, in one transfer device, eleven limit switches are needed to control the operation of a transfer device which is controlled to transfer anode plates from a casting apparatus to a cooling apparatus. In general, prior art devices for transferring anode plates from one station to another typically involve an undesirable number of moving parts, they are difficult to maintain and they wear too rapidly.

What is sought after and what does not appear to be available in the art is a transfer device which is relatively uncomplicated. The sought after device should be relatively easy to maintain. Further, such a device should be one which is usable to transfer articles such as anode plates in a variety of metalworking operations such as those relating to the manufacture of copper, zinc, nickel and cobalt, for example.

SUMMARY OF THE INVENTION

The foregoing problems of the prior art have been overcome by the methods and the apparatus of this invention. An apparatus for transferring an article from one location to another includes a pair of spaced transfer arms which are mounted for rotation. In one embodiment, the other location is one adjacent to a conveyor which is spaced from a pickup position at which the article to be transferred is received by the transfer arms. The transfer arms have free end portions adapted to be moved through the pickup position whereat one end of an article to be transferred is disposed. The article includes a pair of oppositely extending lugs at the one end. The end portion of each arm has a predetermined profile and is adapted to receive a lug thereon as the transfer arms are moved through the pickup position.

Also, the apparatus includes a pair of pickoff arms which may be spaced apart less than the spacing between the transfer arms. Each pickoff arm is mounted for pivotal movement between a pickoff position and a dropoff position adjacent to the conveyor. Further, each pickoff arm has a free end portion adapted to cooperate with the profile of the end portion of each transfer arm to receive a lug of the article as the transfer arms are moved past the pickoff position. Subsequent operation of the pickoff arms causes the article to be deposited on a support such as the conveyor.

In a method of this invention, a pair of spaced transfer arms are moved rotatably to cause specially designed end portions of the arms to engage lugs which extend in opposite directions from opposite sides of an article to be transferred from one position to another. The transfer arms are turned to move the article which has been picked up from a pickup position in an arcuate path to a pickoff position. At the pickoff position are disposed a pair of pickoff arms. The pickoff arms are configured to have first surfaces which define stepped end portions to engage the lugs as the transfer arms are moved rotatably past the pickoff position to cause each lug of an article to become supported on a second surface which defines the stepped end portion of a pickoff arm.

Then the pickoff arms are caused to be moved in another arcuate path from the pickoff position to a dropoff position. The dropoff position is such that as each article is dropped off the pickoff arms, the lugs of the article are supported on a conveyor, for example. With the lugs of each article supported on the conveyor, a portion of the article, which may be an anode plate, extends into a cooling bath. Afterwards, the pickoff arms are returned to reposition the free end portions thereof at the pickoff position.

BRIEF DESCRIPTION OF THE DRAWING

Other features of the present invention will be more readily understood from the following detailed description of specific embodiments thereof when read in conjunction with the accompanying drawings, in which.

DETAILED DESCRIPTION

Figure 1:
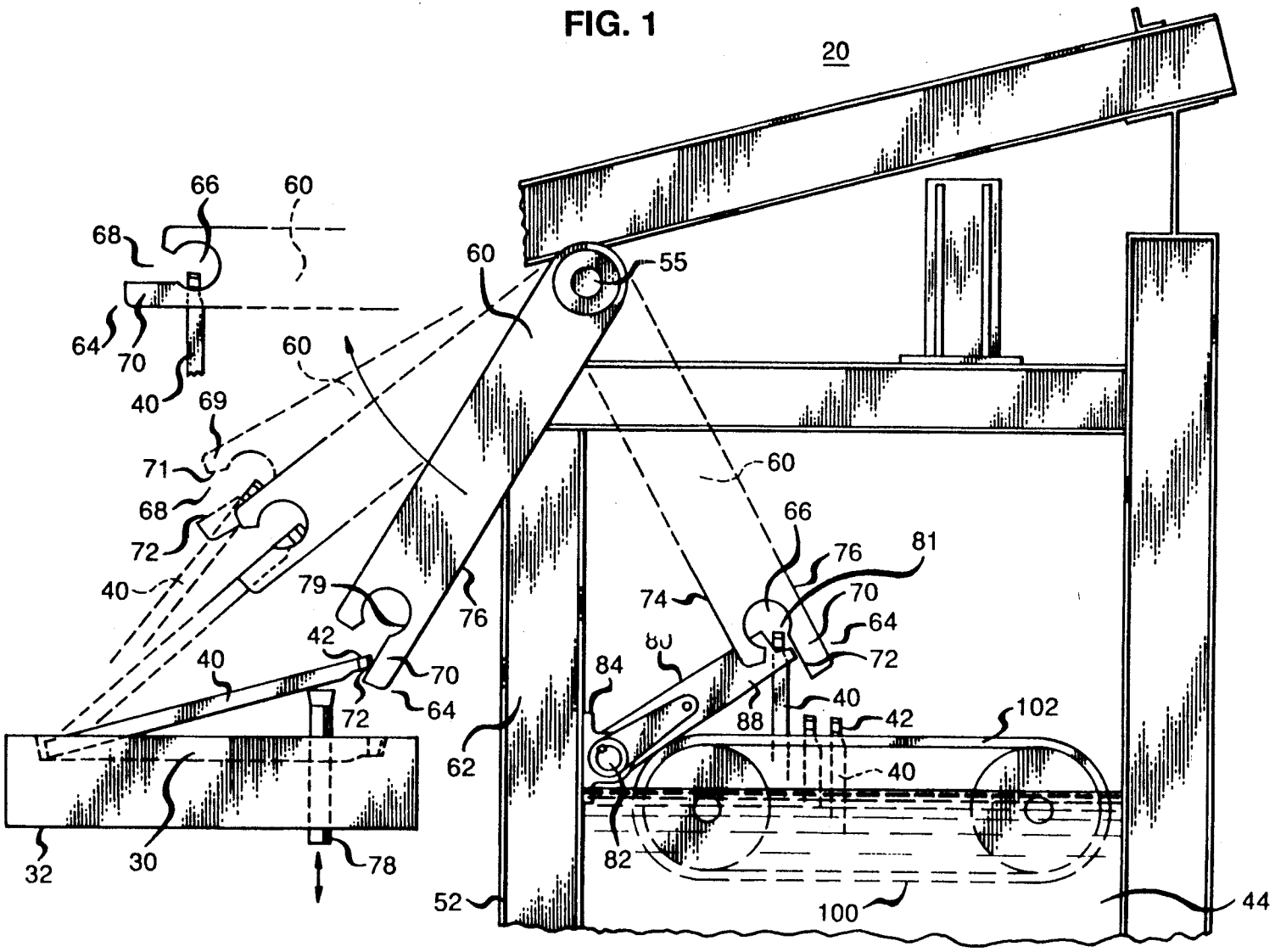
FIG. 1 is an elevational view of an apparatus which includes a pair of spaced transfer arms and which is used to transfer articles from one location to another.
Figure 2:
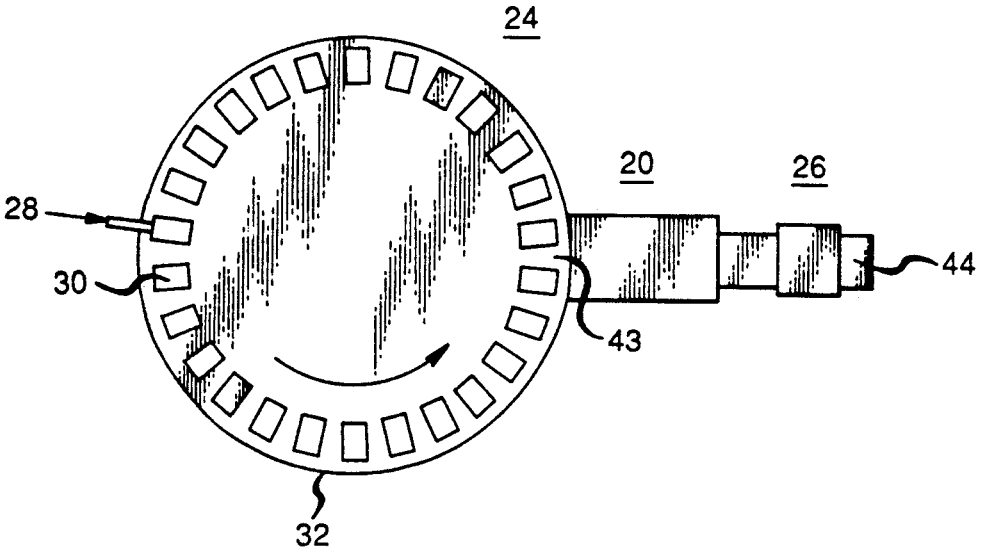
FIG. 2 is a plan view in schematic of apparatus which is used to cast and to cool anode plates for use in metal making operations.

Referring now to FIG. 1 there is shown an apparatus 20 which is used to transfer articles from a casting portion 24 (see FIG. 2) to a cooling portion 26. At the casting portion 24, a molten metal is introduced through a chute 28 to each of a plurality of anode molds 30—30 which are arrayed about a rotatable carriage 32. The carriage 32 and its molds are such that heat of the molds is drawn away as the carriage is caused to be rotated in a counterclockwise direction as viewed in FIG. 2.

Figure 3:
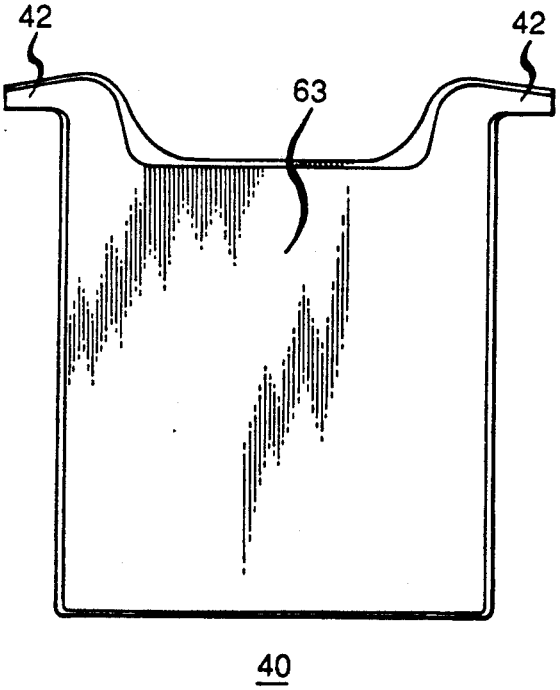
FIG. 3 is an enlarged elevational view of an anode plate which is to be transferred by apparatus of this invention.

Each of the molds 30—30 is adapted to receive molten metal and to cause the metal to assume the configuration of an anode plate 40 as depicted in FIG. 3. As can be seen in FIG. 3, each of the anode plates 40—40 is plate-like and substantially rectangular in configuration. Further, each anode plate has oppositely and outwardly extending lugs 42—42 adjacent to one end thereof.

Figure 4:
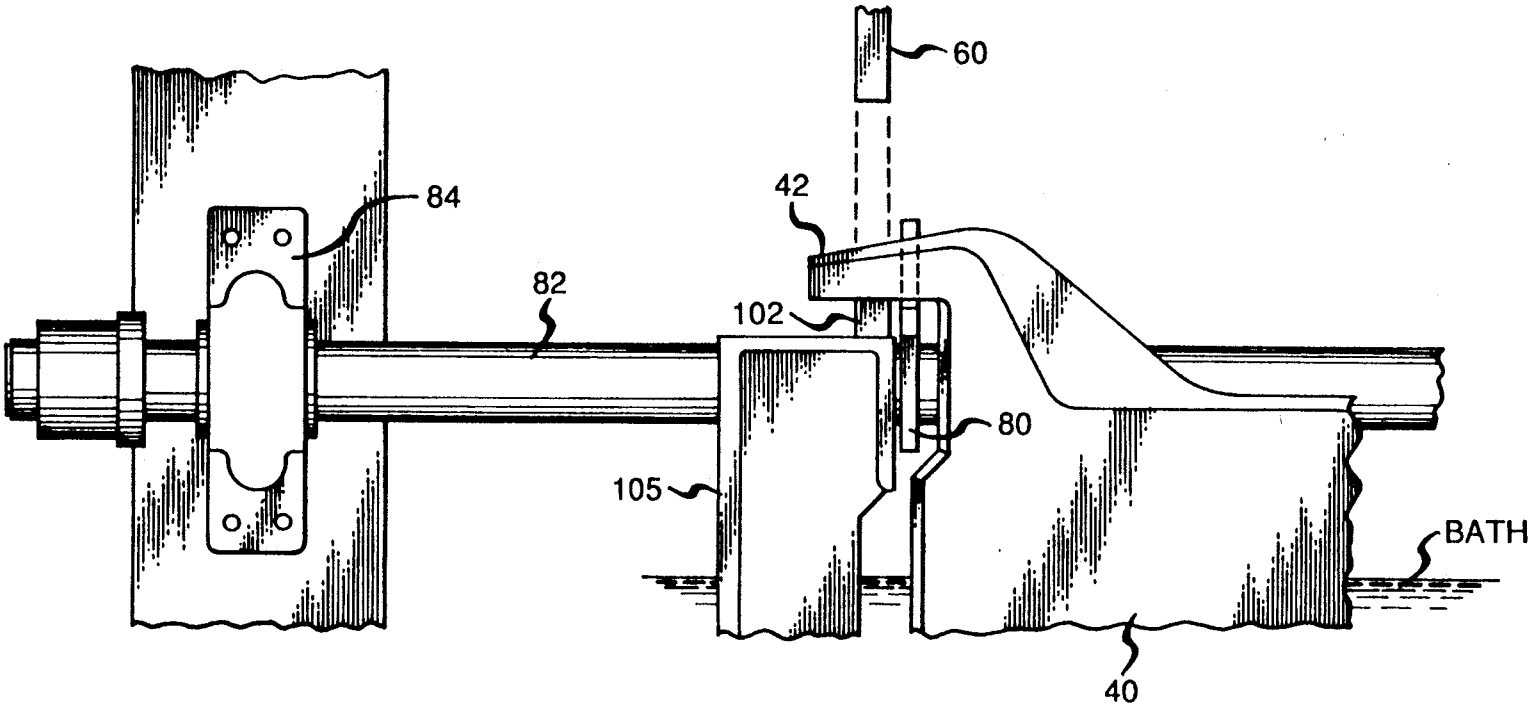
FIG. 4 is a detail end view of a portion of the apparatus of FIG. 1 and of an anode plate being supported on a conveyor and extending into a bath.

Each of the anode plate 40—40 needs to be removed from the carriage 32 at a pickup position 43 (see FIG. 1) and transferred to a cooling bath 44 (see FIGS. 1 and 4) in the cooling portion 26. Afterwards, the anode plates are removed from the cooling bath and suspended along with cathode plates in a bath (not shown) wherein an electrochemical reaction is caused to occur to cause copper in substantially pure form to be deposited on the cathode plates.

Figure 5:
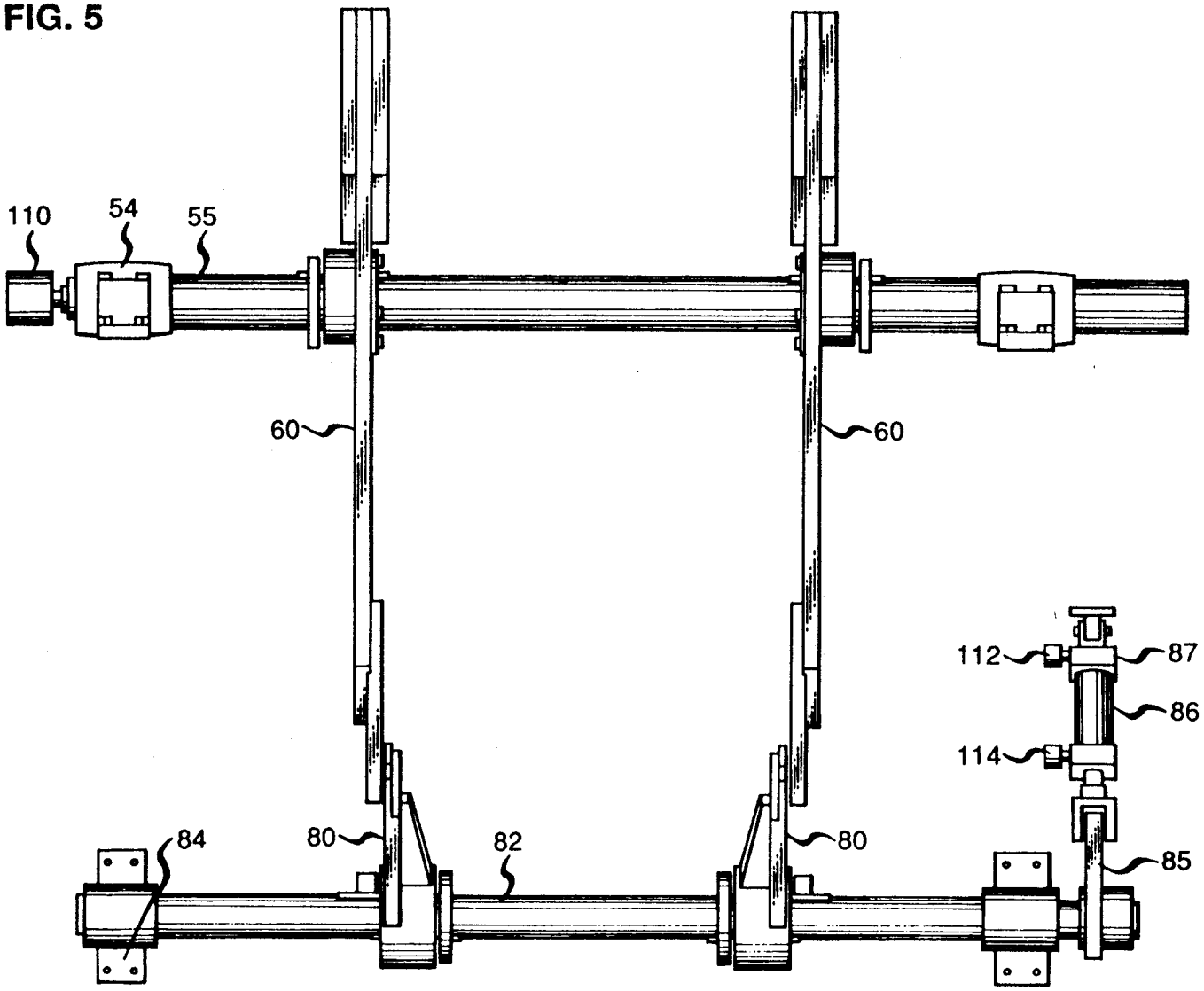
FIG. 5 is an end view of the apparatus of FIG. 1.

Referring again to FIG. 1, it is seen that the apparatus includes a framework 52 which supports a pair of spaced pintles 54—54 (see FIG. 5). Extending between the pintles is a shaft 55 which is adapted to be driven in a clockwise direction as viewed in FIG. 1.

Attached to the shaft 55 are two spaced transfer arms 60—60 (see FIGS. 1 and 5) with the arms being spaced apart a distance which allows the arms to move between columns 62—62 of the framework 52 as the transfer arms are turned in a clockwise direction as viewed in FIG. 1 in a cycle of operation. Further the distance between the transfer arms is greater than the width of a main body portion 63 (see FIG. 3) of an anode plate but less than an out to out distance of the lugs.

Viewing now FIG. 1, it can be seen that a free end portion 64 of each of the transfer arms 60—60 is specially configured. The special configuration is such as to facilitate the pickup of each of the anode plates from the carriage at the pickup position and to facilitate the dropping off of each anode plate at a pickoff position somewhat adjacent to the cooling bath. As can be seen, the free end portion of each arm 60 is provided with a partially circular cutout 66 having an entrance 68. This entrance 68 is defined by a first portion 69 which includes a surface 71 which extends radially from a center of the circular cutout and by a second portion 70. The second portion 70 is defined in part by a surface 72 which is parallel to side edges 74 and 76 of the transfer arm. Also, it will be observed that the second portion extends farther past the center of the cutout than does the first portion.

As can be seen best in FIG. 1, the free end portions of the transfer arms 60—60 are configured so that as the transfer arms approach and are moved into the pickup position, an elevator pin 78 has been controlled to cause the end of the anode plate from which the lugs extend to be raised slightly in its mold. As a result, the surfaces 72—72 of the transfer arms engage the lugs which extend outwardly from opposite edge surfaces of the anode plate.

Continued rotary motion of the transfer arms 60—60 causes the lugs 42—42 to enter the partially circular cutouts and in each to be supported by a surface 79 which defines the cutout. Then as the transfer arms 60—60 are turned in a clockwise direction as viewed in FIG. 1 and moved toward the cooling bath, the lugs 42—42 are caused to be moved along the surfaces 79—79 toward the first portions of the arms in preparation for removal at a pickoff position 81.

Two pickoff arm 80—80 are mounted pivotally on a shaft 82 (see FIGS. 1 and 4) which are supported in bearings 84—84 attached to the columns of the framework. Further, the pickoff arms 80—80 are held to cause free ends thereof to be disposed in the pickoff position 81 by a hydraulically operated cylinder 86 (see FIG. 5) which at one end is attached to a lever 85 extending from the shaft 82. An opposite end 87 of the cylinder 86 is attached to the framework.

Figure 6:
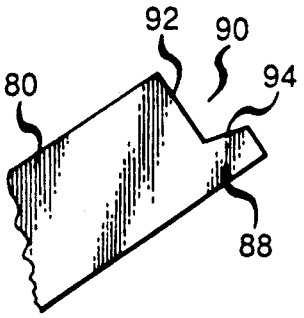
FIG. 6 is a detail view of an end portion of one of two pickoff arms which receive successive anode plates from the transfer arms and which cause each successive anode plate to become supported on a conveyor disposed above a cooling bath.

In order to facilitate pickoff of each successive anode plate from the transfer arms, free end portions 88—88 of the pickoff arms are specially configured. The free end portion 88 of each pickoff arm 80 is provided with a stepped portion or notch 90 (see FIG. 6) defined by two intersecting surfaces 92 and 94. Further, the pickoff arms 80—80 are spaced apart so that they are disposed between and adjacent to the free end portions of the transfer arms 60—60.

The free end portions 88—88 of the pickoff arms 80—80 are held by the cylinder 86 so that as the transfer arms 60—60 sweep therepast, the lugs of each anode plate being carried by the transfer arms engage the surfaces 92—92 and are thereby picked off the transfer arms. As this occurs, the lugs become supported in engagement with the surfaces 94—94 of the pickoff arms.

The transfer arms 60—60 are controlled to continue in their paths until they are disposed vertically in alignment with the columns with the free ends thereof oriented downwardly. The transfer arms remain in this position until the next successive anode plate is moved into the pickup position and is caused to be elevated at its lug end as shown in FIG. 1.

After the anode plate is supported on the surfaces 94—94 of the pickoff arms 80—80, the pickoff arms are controlled to cause the anode plate supported thereon to be deposited at a dropoff point onto a conveyor 100 (see FIG. 1) which comprises spaced conveyor chains 102—102. The chains are spaced apart to allow the lugs 42—42 to become supported thereon. The deposit is accomplished by controlling the cylinder 86 to allow the pickoff arms 80—80 to be turned in a clockwise direction as viewed in FIG. 1. The pickoff arms 80—80 are spaced apart to be able to be moved between the conveyor chains. As this occurs, the lugs of the anode plate 40 move downwardly along the then inclined surfaces 94—94 and are intercepted from the pickoff arms 80—80 by the chains 102—102. The conveyor 100 is caused to be operated to move the anode plate 40 which now is suspended in a cooling bath in a tank 105 (see FIG. 4) further along in the bath. Subsequently, the cylinder 86 is controlled to cause the pickoff arms 80—80 to be moved in a counterclockwise direction to return the free end portions 88—88 of the pickoff arms to the pickoff position 81.

In order to control the operation of the apparatus 20, limit switches are mounted on portions of the apparatus. A first limit switch 110 (see FIG. 5), a rotary one, is mounted on the shaft 55 on which are mounted the transfer arms 60—60. As such, the rotary limit switch 110 senses the orientation of the shaft 55 and the transfer arms mounted thereon. Also, two limit switches 112 and 114 (see again FIG. 5) are associated with the hydraulically operated cylinder 86 which controls the position of the pickoff arms 80—80. One of these limit switches, the switch 112, is disposed at one end of the cylinder 86 and the other, switch 114, at the other end. As the cylinder 86 is controlled by the limit switch 112 to extend a piston rod therefrom and move the pickoff arms 80—80 downwardly in a clockwise direction to a dropoff point to drop off an anode plate 40, the limit switch 110 is operated to cause the rotation of the transfer arms to be discontinued. When the cylinder 86 has been operated to extend completely the rod therefrom, the limit switch 114 is operated to cause the cylinder to retract the piston rod and thereby turn the pickoff arms in a counterclockwise direction.

In a cycle of operation, the rotary limit switch 110 causes the rotation of the transfer arms 60—60 to be discontinued when they are oriented to have their end portions slightly past the pickoff position. At that time, the limit switch 112 controls the apparatus 20 to cause the cylinder 86 to cause the pickoff arms 80—80 to be moved in a clockwise direction as viewed in FIG. 1 to the dropoff position. After the conveyor intercepts the anode plate being carried by the pickoff arms, movement of the pickoff arms continues sufficiently to disengage the pickoff arms from the lugs of the anode plate. Then, a limit switch (not shown) associated with the conveyor causes the conveyor to index through one step to move the just-received anode plate deposited thereon by the pickoff arms 80—80 to be moved out of the dropoff position. Subsequently, the limit switch 114 associated with the cylinder is actuated and controls the cylinder to retract the rod and thereby return the pickoff arms 80—80 to the pickoff position. When the free ends of the pickoff arms 80—80 become disposed at the pickoff point, operation of the cylinder is discontinued and rotation of the shaft 55 and of the transfer arms mounted thereon is continued. The rotation of the transfer arms 60—60 is controlled by the limit switch to pause when oriented substantially vertically downwardly to allow the next successive anode mold to be indexed into the pickup position.

It is to be understood that the above-described arrangements are simply illustrative of the invention. Other arrangements may be devised by those skilled in the art which will embody the principles of the invention and fall within the spirit and scope thereof.

I claim:

1. An apparatus for transferring successive plate-like articles each of which includes oppositely and outwardly extending lugs at one end thereof from a first location to a second location, said apparatus comprising:

a pair of spaced transfer arms which are mounted for rotation and which have free end portions adapted to be moved in an arcuate path through a pickup position whereat one end of each successive article in a casting mold is disposed, the end portion of each arm including a cutout which has a predetermined profile and which is effective to capture a lug of the article in the pickup position as said transfer arms are moved therethrough to cause the lugs to be supported thereon and the article to be picked up and carried along an arcuate path by said transfer arms;

a conveyor spaced from the pickup position whereat each successive article is received from a casting mold; and a pair of pickoff arms which are spaced apart a distance less than the spacing between said transfer arms to allow said pickoff arms to become disposed between said transfer arms as said transfer arms are moved rotatably toward said conveyor and which have supporting portions disposed in arcuate paths of the free end portion of the transfer arms having the lugs supported thereon, said pickoff arms being mounted for pivotal movement between a pickoff position and a dropoff position adjacent to said conveyor and each having a free end portion adapted to cooperate with the profile of said cutout of an associated transfer arm to engage a lug of each successive article as said transfer arms are moved rotatably past the pickoff position and to cause the lug to be supported in engagement with a surface which defines the end portion of said each pickoff arm; and means responsive to the removal of an article from said transfer arms and support on said pickoff arms for causing said pickoff arms to be moved rotatably from the pickoff position to the dropoff position to cause the lugs of the article to become engaged with said conveyor.

2. The apparatus of claim 1, wherein said transfer arms are caused to be moved in a single rotational direction from the pickup position to the pickoff position and then return to the pickup position.

3. The apparatus of claim 2, wherein a free end portion of each said transfer arm includes a partially circular opening with a portion of said arm on one side of said arm extending beyond an opposite side of said arm.

4. The apparatus of claim 2, wherein said pickoff arms are attached to a rotatably mounted shaft and wherein each said pickoff arm includes a stepped end portion which is such that when said free end portion of said each pickoff arm is aligned with said cutout portion of an associated one of said transfer arms, a lug of an article carried by said associated transfer arm abuts a first portion of the stepped end portion of said pickoff arm to cause the article carried by said transfer arms to be removed therefrom and supported by second portions which define said stepped end portions.

5. The apparatus of claim 4, wherein each said stepped end portion is such that as said pickoff arm is turned rotatably, said first portion of each said stepped end portion is moved adjacent to said conveyor to allow said article to be intercepted by said conveyor and to become disengaged from said pickoff arms.

6. The apparatus of claim 5, which also includes means for causing said transfer arms to decelerate as said transfer arms approach the pickoff position and means for sensing the position of said transfer arms.

7. The apparatus of claim 5, wherein pivotal movement of said pickoff arms is caused by a cylinder which has a rod extending therefrom and being connected to said shaft on which are mounted said pickoff arms.

8. The apparatus of claim 7, which also includes means associated with said pickoff arm for sensing the extension and retraction of said rod to determine the orientation of said pickoff arms.

9. The apparatus of claim 1, wherein said transfer arms are mounted on a shaft and said apparatus also including means for sensing the rotary orientation of said shaft on which are mounted said transfer arms.

10. A method of transferring an article having lugs extending in opposite directions from one end thereof, said method including the steps of:

causing a pair of spaced rotatably mounted transfer arms to be moved to engage the lugs of the article at a pickup position and to carry the article in a direction along a first arcuate path;

positioning free end portions of two spaced, pivotally mounted pickoff arms at a pickoff position so that as the lugs continue in the first arcuate path, the lugs engage first surfaces which define stepped free end portions of the pickoff arms whereby the travel of the article in the first arcuate path is arrested and the lugs become supported by engagement with second surfaces which define the stepped end portions of the pickoff arms;

causing the lugs to be moved along a second arcuate path to cause the article to be moved downwardly to a dropoff position;

discontinuing the movement along the second arcuate path when the lugs have engaged a support adjacent to the dropoff position;

returning the pickoff arms to reposition the free end portions thereof at the pickoff position; and causing the transfer arms to continue to be moved to return to the pickup position to pick up the next successive article, wherein rotation of the transfer arms is in a single rotary direction and is effective to cause a specially configured end portion of each transfer arm to engage a lug and pick up the article in the pickup position and to carry the article into the pickoff position whereat continued motion of the transfer arms causes the lugs to engage the first surfaces of the pickoff arms positioned in the path of travel of the transfer arms whereupon the article becomes supported on the pickoff arms by engagement of the lugs with the second surfaces which intersect the first surfaces.

11. The method of claim 10, wherein the transfer arms are caused to rotate in a single rotary direction from the pickup position to the pickoff position and then return to the pickup position.

12. The method of claim 11, wherein the rotation of the transfer arms is discontinued while the pickoff arms are being caused to move the article to the support and during the return of the pickoff arms to the pickoff position.

13. The method of claim 11, wherein subsequent to the engagement of the lugs with the support adjacent to the dropoff position, the article is moved out of the dropoff position to allow the pickoff arms to be returned to the pickoff position.

* * * * *